US007571553B2

(12) United States Patent
Joerger et al.

(10) Patent No.: US 7,571,553 B2
(45) Date of Patent: Aug. 11, 2009

(54) CONTROL USER INTERFACE FOR LAUNDRY APPLIANCES

(75) Inventors: Steven John Joerger, Ames, IA (US); Michael Paul Ricklefs, Webster City, IA (US); Sean Florian Myers, Ames, IA (US)

(73) Assignee: Electrolux Home Products, Inc., Cleveland, OH (US)

( * ) Notice: Subject to any disclaimer, the term of this patent is extended or adjusted under 35 U.S.C. 154(b) by 207 days.

(21) Appl. No.: 11/566,095

(22) Filed: Dec. 1, 2006

(65) Prior Publication Data

US 2008/0127999 A1 Jun. 5, 2008

(51) Int. Cl.
*F26B 7/00* (2006.01)

(52) U.S. Cl. ..... 34/378; 381/526; 381/528; 381/534; 381/535; 381/549; 381/89; 381/595; 34/381; 34/600

(58) Field of Classification Search ..... 34/378, 34/281, 526, 528, 534, 535, 549, 89, 595, 34/600

See application file for complete search history.

(56) References Cited

U.S. PATENT DOCUMENTS 2,114,776 A * 4/1938 Davis ..... 68/18 R
2,911,810 A * 11/1959 Lantz et al. ..... 68/12.15
3,100,144 A * 8/1963 Vanderslice et al. ..... 34/527
3,286,361 A * 11/1966 Cobb et al. ..... 34/445
3,381,389 A * 5/1968 Kurowski ..... 34/527
3,398,460 A * 8/1968 Elders ..... 34/533
3,475,830 A * 11/1969 Botts et al. ..... 34/533
3,491,458 A * 1/1970 Elders et al. ..... 34/533
3,593,544 A * 7/1971 Henderson ..... 68/22 R
3,944,841 A * 3/1976 Janke ..... 307/38
4,226,026 A * 10/1980 Deming et al. ..... 34/445
4,372,054 A * 2/1983 Pomerantz et al. ..... 34/526
4,418,271 A * 11/1983 Smock ..... 219/493
4,422,247 A * 12/1983 Deschaaf ..... 34/550

(Continued)

FOREIGN PATENT DOCUMENTS

JP 04035698 A * 2/1992

OTHER PUBLICATIONS

International Search Report, PCT/US06/46007, maildate Aug. 22, 2007.

*Primary Examiner*—Stephen M. Gravini
(74) *Attorney, Agent, or Firm*—Banner & Witcoff, Ltd.

(57) ABSTRACT

A control user interface for laundry appliances, such as a clothes dryer or washing machine, enables a user to control multiple modes of operation and a variable associated with at least one mode of operation by manipulating a single control element. In one arrangement, the variable is time and multiple time increments are associated with at least one mode of operation. One embodiment includes a rotatable single control knob. Upon detecting the rotation of the control knob, a determination is made whether the currently selected operation mode has associated operation times to be presented to the user. If no associated operation times are presented, the user interface display is updated to reflect the next mode of operation. The operation mode and operation times may be part of different display region within the dryer control user interface. Thus, multiple menus and submenus can be traversed and selected from using a single control knob, without the need for secondary buttons or a base cycle position to control the mode operation and time settings.

18 Claims, 4 Drawing Sheets

U.S. PATENT DOCUMENTS 4,481,786 A * 11/1984 Bashark ..... 62/160
4,520,576 A * 6/1985 Vander Molen ..... 34/534
4,640,022 A * 2/1987 Suzuki et al. ..... 34/552
4,640,344 A * 2/1987 Pravda ..... 165/86
4,702,018 A * 10/1987 Hastings ..... 34/130
4,763,425 A 8/1988 Grennan
4,788,775 A * 12/1988 Ahmed ..... 34/552
5,101,575 A * 4/1992 Bashark ..... 34/562
5,161,314 A * 11/1992 Souza ..... 34/493
5,537,761 A * 7/1996 Oh ..... 34/499
5,564,831 A * 10/1996 Bashark ..... 374/141
5,619,614 A * 4/1997 Payne et al. ..... 706/1
5,682,684 A * 11/1997 Wentzlaff et al. ..... 34/495
5,782,012 A 7/1998 Sanders et al.
6,047,486 A * 4/2000 Reck et al. ..... 34/491
6,154,201 A 11/2000 Levin et al.
6,385,862 B1 * 5/2002 Vande Haar ..... 34/441
6,493,963 B1 * 12/2002 England ..... 34/491
6,502,265 B2 1/2003 Blair et al.
6,519,871 B2 * 2/2003 Gardner et al. ..... 34/497
6,636,197 B1 10/2003 Goldenberg et al.
6,727,443 B2 4/2004 Peterson et al.
6,757,988 B2 * 7/2004 Bruntz et al. ..... 34/543
6,775,924 B2 * 8/2004 Bruntz et al. ..... 34/543
6,791,288 B2 9/2004 Peterson et al.
6,796,055 B2 * 9/2004 Baltes ..... 34/449
6,813,911 B2 11/2004 Peterson et al.
6,845,290 B1 * 1/2005 Wunderlin et al. ..... 700/208
6,940,049 B2 * 9/2005 Harwell et al. ..... 219/482
6,954,995 B2 * 10/2005 Kitamura et al. ..... 34/597
6,968,632 B2 * 11/2005 Guinibert et al. ..... 34/602
7,013,577 B2 * 3/2006 Kegler ..... 34/89
7,013,578 B2 * 3/2006 Wunderlin et al. ..... 34/528
7,055,262 B2 * 6/2006 Goldberg et al. ..... 34/86
7,065,905 B2 * 6/2006 Guinibert et al. ..... 34/603
7,117,613 B2 * 10/2006 Guinibert et al. ..... 34/534
7,225,562 B2 * 6/2007 Guinibert et al. ..... 34/601
7,257,905 B2 * 8/2007 Guinibert et al. ..... 34/82
7,412,783 B2 * 8/2008 Guinibert et al. ..... 34/572
7,467,483 B2 * 12/2008 Guinibert et al. ..... 34/601
7,478,486 B2 * 1/2009 Wunderlin et al. ..... 34/491
2002/0174564 A1 * 11/2002 England ..... 34/606
2002/0184789 A1 * 12/2002 Gardner et al. ..... 34/491
2003/0217480 A1 * 11/2003 Bruntz et al. ..... 34/543
2003/0217481 A1 * 11/2003 Bruntz et al. ..... 34/557
2004/0045187 A1 * 3/2004 Curry et al. ..... 34/595
2004/0064966 A1 * 4/2004 Baltes ..... 34/443
2004/0200093 A1 * 10/2004 Wunderlin et al. ..... 34/606
2004/0216326 A1 * 11/2004 Kitamura et al. ..... 34/597
2004/0226187 A1 * 11/2004 Bruntz et al. ..... 34/527
2005/0066538 A1 * 3/2005 Goldberg et al. ..... 34/218
2005/0076535 A1 * 4/2005 Guinibert et al. ..... 34/601
2005/0097773 A1 * 5/2005 Gardner ..... 34/606
2005/0115104 A1 * 6/2005 Guinibert et al. ..... 34/601
2006/0117595 A1 * 6/2006 Virzi et al. ..... 34/607
2006/0179676 A1 * 8/2006 Goldberg et al. ..... 34/77
2006/0191161 A1 * 8/2006 Wunderlin et al. ..... 34/562
2007/0006477 A1 * 1/2007 Guinibert et al. ..... 34/85
2007/0017113 A1 * 1/2007 Scharpf et al. ..... 34/86
2007/0186440 A1 * 8/2007 Guinibert et al. ..... 34/603
2007/0220776 A1 * 9/2007 Guinibert et al. ..... 34/603
2008/0168679 A1 * 7/2008 Son et al. ..... 34/497
2008/0307667 A1 * 12/2008 Ikemizu ..... 34/132
2008/0312773 A1 * 12/2008 Nag ..... 700/275
2009/0071032 A1 * 3/2009 Kreutzfeldt et al. ..... 34/389

* cited by examiner

CONTROL USER INTERFACE FOR LAUNDRY APPLIANCES

BACKGROUND

Automatic clothes dryers typically include a dryer user interface through which users can control dryer settings for drying loads of laundry. Dryer control user interfaces have typically included a combination of components such as dials, buttons, light emitting diodes (LEDs), and/or digital displays to control and/or display dryer settings. Despite the previous attempts to improve upon conventional dryer interfaces, there remains a need for a dryer control user interface that allows users to quickly, simply, efficiently, and unambiguously set modes of operation, times, and other dryer settings.

SUMMARY OF THE INVENTION

According to a first aspect of the invention, a laundry appliance includes a control element and a user interface, which may be located on a control panel. The user interface has a mode display region for indicating an operation mode for the laundry appliance and a numerical display region for indicating a value of a variable associated with a mode for the laundry appliance. Based on a sequence of operation modes and multiple values of the variable associated with the mode, manipulation of the control element changes the operation mode and its indication in the mode display region, and also changes the value of the variable associated with the mode and its display in the numerical display region, based on the sequence.

According to another aspect, a laundry dryer includes a rotatable control knob, and first and second displays. The first display is configured to display at least one of a plurality of options corresponding to a first menu. The second display is configured to display at least one of a plurality of options corresponding to a second menu. The second menu is a submenu of the first menu such that the plurality of options corresponding to the second menu are each associated with a first menu option. The rotatable control knob is coupled to the first and second displays so that the dryer (a) changes the first display from displaying a first option from the first menu to displaying a second option from the first menu in response to a first rotation of the rotatable control knob; (b) changes the first display from displaying a second option from the first menu to displaying a third option from the first menu, and displaying on the second display a first option from the second menu in response to a first subsequent rotation of the rotatable control knob; and (c) changes the second display from displaying a first option from the second menu to displaying a second option, while continuing to display the third option of the first menu in the first display in response to a second subsequent rotation of the rotatable control knob. The first and second options of the second menu correspond to sub-options available that correspond with the third option of the first menu.

In yet another aspect, method for controlling the operation of laundry appliance having a user-manipulable control element, a plurality of primary operational mode state settings corresponding to control settings of the laundry appliance, and a plurality of secondary operational mode state settings corresponding to a designated primary operational mode state setting, includes three mode changing steps in response to detections of manipulations of the control element. A first step changes the primary operational mode state setting from a first operational mode to a second operational mode in response to a detection of first manipulation of the control element. A second step changes the primary operational mode state setting from the second operational mode to a third operational mode and designating a secondary operational mode state setting as a first operational mode in response to a detection of a first subsequent manipulation of the control element in the same direction as the first manipulation. A third step changes the secondary operational mode state setting from the first operational mode to a second operational mode while maintaining the setting of the primary operational mode state setting as the third operational mode in response to a detection of a second subsequent manipulation of the control element in the same direction as the first manipulation and the first subsequent manipulation.

According to yet another aspect, a dryer control user interface enables a user to control multiple modes of operation and multiple time increments associated with the modes of operation by rotating a single control knob, without the need for secondary buttons or a base cycle position to control the dryer mode operation and time settings. Upon detecting the rotation of the control knob, a determination is made whether the currently selected operation mode has associated operation times which are to be presented to the user. If no associated operation times are to be presented, the user interface display is updated to the next mode of operation. The operation mode may be part of a first display region and the operation time may be part of a separate second display region.

According to another aspect of the invention, a user interface enables a user to traverse into and select values from menus and submenus in a hierarchy using a single control knob. As the knob is turned in a single direction, the user interface display is updated, both with values from a menu and with values from a submenu associated with specific values of the menu. A turn threshold for the control knob may determine the point at which the next set of menu values or submenu values will be displayed. According to yet another aspect, the control knob may be turned in the opposite direction to traverse the opposite way through the menu hierarchy.

The above and other objects, features and advantages of the present invention will be readily apparent and fully understood from the following detailed description of preferred embodiments, taken in connection with the appended drawings.

DETAILED DESCRIPTION

Figure 1:
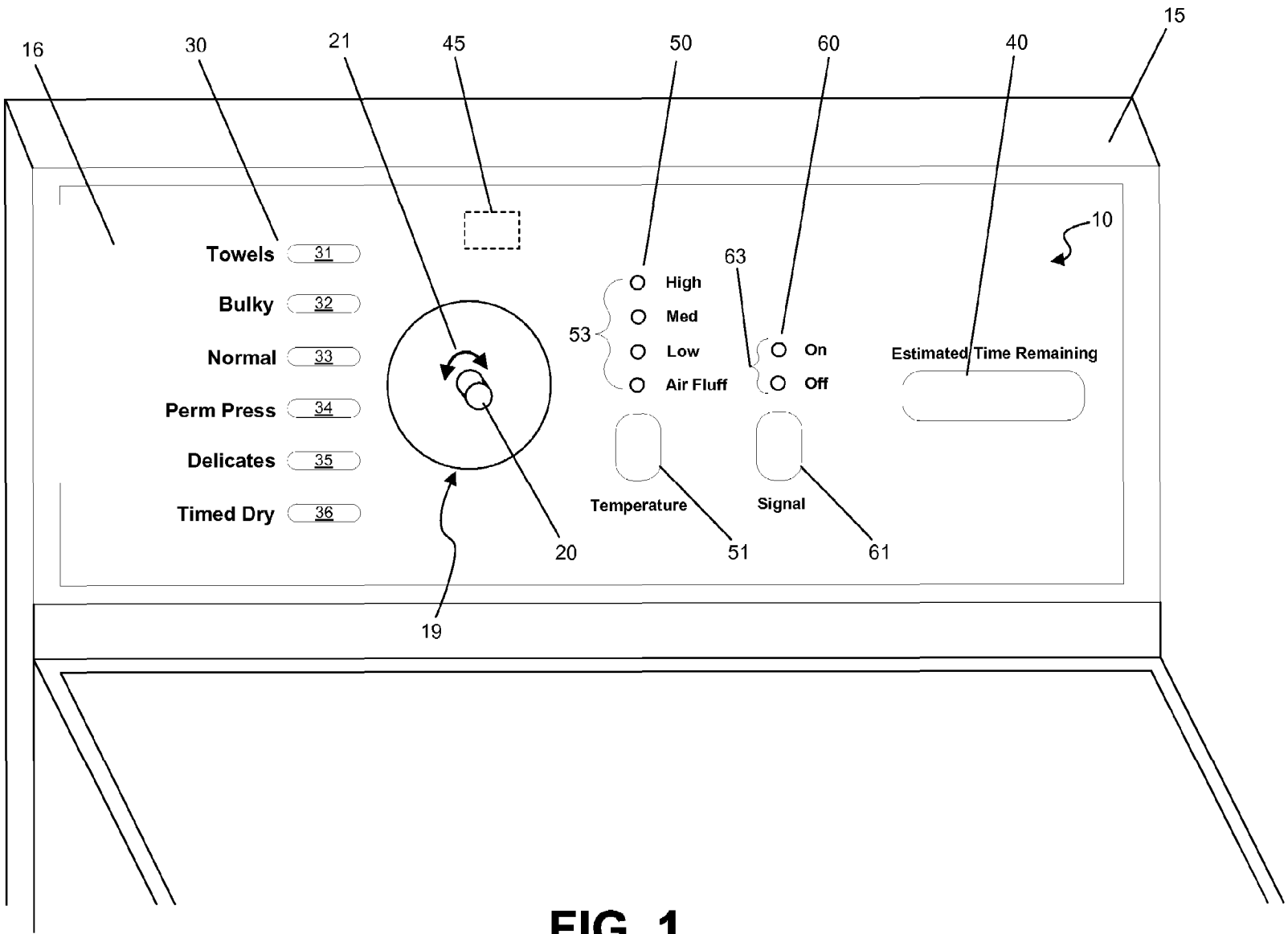
FIG. 1 is a diagrammatic perspective view of a dryer with a dryer control user interface constructed in accordance with certain aspects of the invention.

With reference to FIG. 1, an illustrative laundry appliance control user interface 10 is shown. While the depicted illustrative laundry appliance 15 is a dryer for laundry, it is recognized that control user interface 10 is compatible for use with other types of laundry appliances such as clothes washing machines. The components of user interface 10 are positioned on a control panel 16 of the dryer 15 to allow a user to control and monitor the operation of the dryer 15. The dryer 15 may include a controller, schematically depicted by reference number 45, which is preferably located internal to the housing of the dryer. The controller 45 coordinates transmission and receipt of information from the user interface 10, and uses this information to control the operation of the dryer 15. The controller 45 may be part of any suitable digital or analog circuitry and may include a processor. The laundry appliance, e.g., the dryer or washing machine includes various mechanical, electrical, and other elements for carrying out the drying and washing process, and any suitable arrangement for accomplishing these functions may be used. Accordingly, the controller 45 is operably coupled to the user interface 10 and the other elements for carrying out the drying and washing process.

User interface 10 includes a primary control element 19 whereby the user may input a desired setting for the laundry appliance. In one arrangement, the primary control element is a user-movable element in the form of a rotatable control knob 20. The control knob 20 is mounted to the control panel of the dryer 15 in an independently rotatable fashion to allow the user to turn the knob 20 in a desired rotational direction (i.e., clockwise and/or counter-clockwise; see arrow 21). The primary control element 19, e.g., knob 20, is used by the user to traverse through a menu/submenu hierarchy.

Alternative primary control element 19 embodiments that could be used in lieu of knob 20 include a three-position center-biased slider, a three-position center-biased pivotable toggle, and two closely spaced discrete buttons grouped together. In one arrangement, as depicted, the primary control element 19 is the only user control element for making a control setting selection.

An operation menu displaying modes and at least one multi-analog setting associated with one of the modes is part of user interface 10, and is preferably on control panel 16. In one arrangement, there is a mode menu 30 that informs the user of the currently selected mode for the dryer 15. In the depicted embodiment, the menu 30 includes a set of light emitting diodes (LEDs) 31-36, one for each corresponding operation mode. In this case, and with the laundry appliance being a clothes dryer, the modes may be: "Towels" designated by LED 31, "Bulky" designated by LED 32, "Normal" designated by LED 33, "Permanent Press" designated by LED 34, "Delicates" designated by LED 35, and "Timed Dry" designated by LED 36. Suitable text indicia of the operation mode are included on the control panel adjacent to their respective LEDs 31-36. In certain embodiments, only one operation mode is selectable at a single time, and thus only one LED 31-36 would be lit at a single time.

A display 40 is also preferably part of user interface 10, and is preferably also on control panel 16. The display 40 is usable with at least one of the modes. In the illustrated embodiment, the display 40 displays numerals corresponding to at least two settings other than "on" or "off". For example, display 40 may display numerical data, usable in association with at least the Timed Dry mode in the depicted arrangement. For example, the numerical display 40 may serve as an estimated time remaining display 40 to provide time information (e.g., as a digital display of minutes) to the user during the selection of the operation mode and time by the user, and during the drying of a load of laundry. Display 40 may take the form of an LED display or an LCD, or any alternative display arrangement capable of displaying numeric data. In addition, the display may display settings data in a non-numerical form, such as letters of the alphabet (e.g., A, B, C, etc.), which may or may not form text messages, or other characters or icons. Such characters or icons may be indicative or time intervals or other operation settings related variables.

Figure 3:
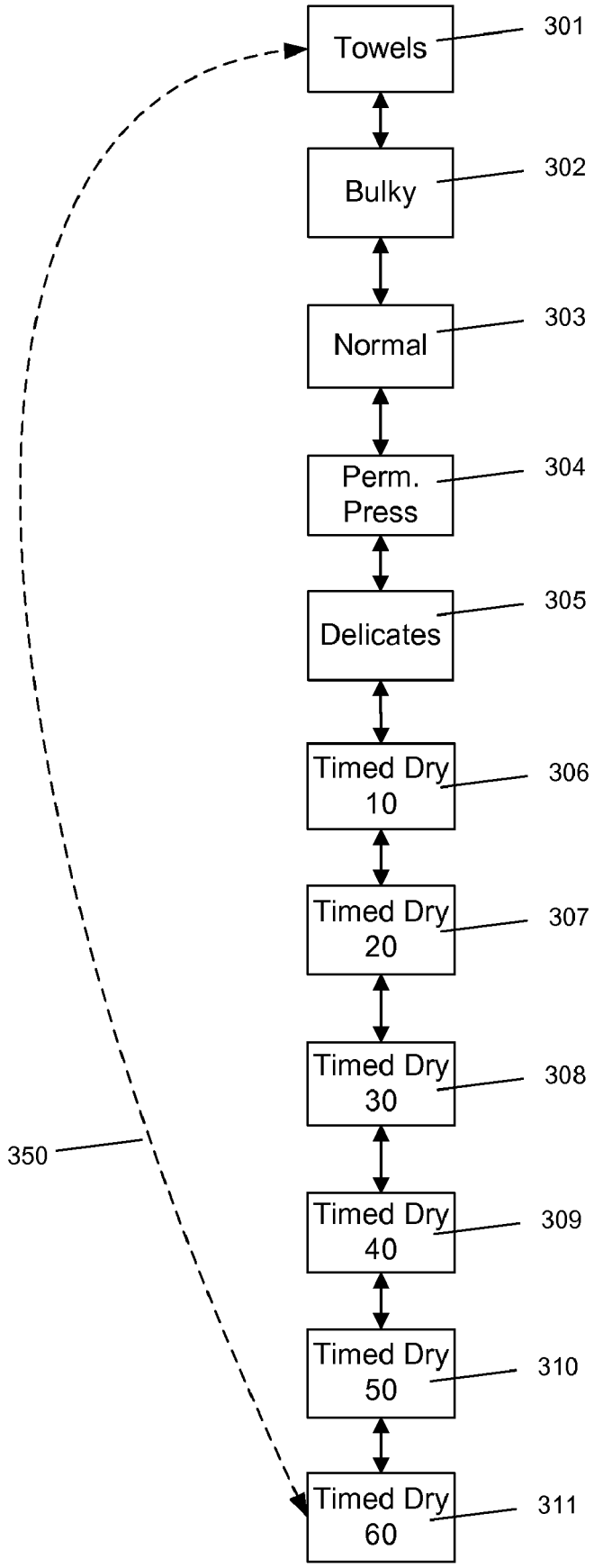
FIGS. 3-4 are diagrammatic illustrations showing a selection process for values within multiple menus and submenus, in accordance with certain aspects of the invention.

Referring now to FIG. 3, an illustrative state diagram is shown demonstrating a selection process of mode and time dryer settings. The state diagram in this example may correspond to the dryer control user interface 10 shown in FIG. 1. As described above, the user turns the control knob 20 to select a dryer operating mode for the dry cycle. In this example, the first selectable dryer mode is "Towels" 301. This may be the initial default mode. Alternatively, if the user were to stop turning the control knob 20 at this selection, the towel mode LED 31 would be only LED of the mode LEDs 31-36 lit on the user interface 10. Further, and for this example state, there would not be any content displayed on numerical display 40.

If this mode were selected, the user-selected operation mode ("Towels") would begin based off of defaults operational instructions stored in the controller of the dryer 15. For starting the operation of the dryer based on the current mode, any suitable arrangement may be used. In one arrangement, the dial 20 or at least a portion thereof may axially displaced either by being pushed in or pulled out. Such axial displacement would be sensed and would initiate operation of the dryer. In alternative embodiments, a distinct user control input element can be used and such, when selected, would initiate operation of the dryer. The laundry appliance may then be operated to carry out operation in the selected mode as is known in the art.

If the user chooses not to select for operation the "towels" mode, the user can turn the control knob 20 of the dryer 15 in the same direction (e.g., clockwise), the different menu selections in the operation mode menu 30 are displayed in sequence on the user interface 10. Thus, for example, when the current selection is "Towels" 301, and the towel mode LED 31 is lit on the user interface 10, turning the control knob clockwise will change the current user-selected mode to "Bulky" 302. The user will be notified of the change via the LEDs 31-32 as LED 32 would illuminate and LED 31 would turn off. The user may then select the Bulky mode or continue to move through the menu. For example, if the user continues to turn knob 20 in the same direction, it will change the current user-selected mode from "Bulky" to "Normal" and the user will be notified of the change as LED 33 would illuminate and LED 33 would turn off. These are shown in the state diagram of FIG. 3 as States 301-305.

According to the depicted embodiment, this navigation would sequentially move through the states 301-305 and LEDs 31 to 35 until the user rotates the control element 19 to reach the "Timed Dry" mode. The "Timed Dry" mode makes use of the numerical display 40, and does so as a time-based variable in a secondary menu. When the user rotates the control knob 20 to past the "Delicates" operation mode, the operation mode becomes "Timed Dry" and a numerical variable is displayed in display 40. In this example, the number "10" is displayed in the display and the state would be "Timed Dry 10." In other words, if this was selected, the dryer would operate for 10 minutes and would automatically turn off after that predetermined period of time. This state is reflected in FIG. 3 as State 306.

As the user continues (or resumes) turning the knob in the same direction, Timed Dry mode LED 36 will remain lit while different time values (e.g., "10:00" (306), "20:00" (307), "30:00" (308) "40:00" (309), "50:00" (310), and "60:00" (311)) are digitally displayed in the display 40. This is reflected in States 306-311 of FIG. 3. Thus, the user can navigate the operation time submenu by simply continuing to turn the same control knob 20 in the same direction as when the user was navigating through list (i.e., menu) of operation modes. The association of clockwise and/or navigation order with an increasing time period in the Timed Dry mode is used as an illustrative arrangement only, as clockwise and/or the opposite navigation order could be used to correspond to a decreasing time period.

The state transition arrows in FIG. 3 are double-sided, indicating that the user may rotate the control knob 20 backwards as well as forward to navigate through the menu-submenu hierarchy (e.g., by turning the knob 20 clockwise and counterclockwise).

Although this example only describes a two-level hierarchy of menus and submenus, the present invention is not limited as such. The dryer 15 may integrate many levels of menus, submenus, sub-submenus, and so on, all of which may be accessible through the turning of a single control knob 20. As in the above two-level example, when a submenu is encountered while traversing through the selections of the top-level menu, the traversal of the top-level menu is stopped while the submenu is traversed completely. Similarly, if during the traversal of that submenu an embedded tertiary menu is encountered, traversal of the submenu will stop until all of the selections in the tertiary menu have been traversed. This pattern will continue recursively until the hierarchy is completely traversed, thus ensuring that every possible selection in a menu or any submenu becomes available to the user through the use of a single control knob 20.

Returning now to FIG. 3, the dotted line 350 connecting state 301 with state 311 indicates that menu navigation can be endless and the user can directly transition between the two states 301 and 311. That is, in some embodiments, as the user continues to the turn the control knob 20 in the same direction after reaching the final state 311, the user may be returned to the initial state 301, in effect creating a endless cycle though the operation mode and operation time selections for the dryer 15. However, in an alternative embodiment, the menu can have endpoints and continuing to turn the knob 20 past the designated last state 311 may have no effect on the operation mode/time user-selection, or on the user interface 10. In such embodiments, the final state 311 in the hierarchy may act as a dead end, requiring the user to change directions and back out of the hierarchy (e.g., by turning the control knob 20 in the opposite direction).

Figure 4:
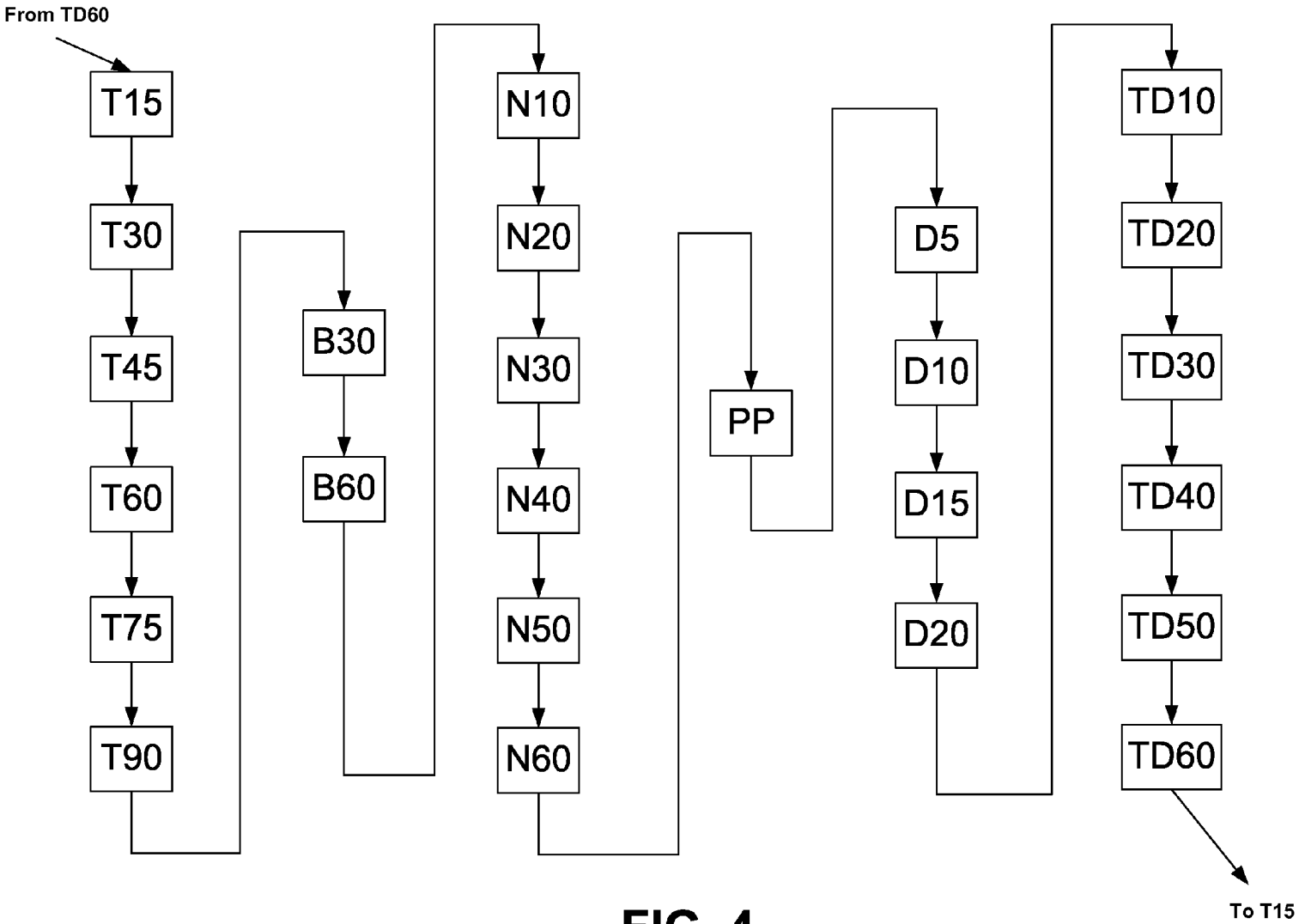

In FIG. 4, another illustrative state diagram is shown demonstrating a different menu/submenu hierarchy usable to select the operation mode and operation time for the dryer 15. The state diagram in FIG. 4 is also compatible with the dryer control user interface 10 shown in FIG. 1. As in FIG. 3, the user may turn the control knob 20 in a single direction to traverse the menus and submenus of the hierarchy, essentially treating the multi-leveled hierarchy like a simple flat list. However, in this example, "Timed Dry" is not the only operation mode with an operation time submenu. Instead, operation modes "Towels" T15-T90, "Bulky" B30-B60, "Normal" N10-N60, and "Delicates" D5-D20 also have an operation time submenu embedded into the hierarchy represented by FIG. 4. Thus, a user turning the control knob 20 to traverse through the operation modes will have to see all six time values associated with "Towels" mode before reaching the "Bulky" operation mode, or any of the subsequent modes. As described above, as the user traverses through the state shown in FIG. 4, the dryer control user interface 10 will update at each state transition, displaying the current user-selection for operation mode in mode menu 30, and the current user-selection for operation time for that mode (if applicable) on the numerical display 40.

Each column of boxes in FIG. 4 corresponds to a different operation mode. That is, the state boxes starting with the letter "T" (and not "TD") represent different time intervals for the "Towel" operation mode, and so on. Note that the number of possible operation time selections may differ based on the operation mode. For example, in this configuration, the "Delicates" operation mode has four possible operation times, 5 minutes, 10 minutes, 15 minutes, and 20 minutes. In contrast, the "Normal" operation mode has six possible operation times ranging from 10 minutes to 60 minutes in 10 minute increments. Thus, the number possible operations times, the starting point time, and the level of precision between increments, may all be configured to match the selected operation mode. In more general terms, different submenus at the same level of the menu/submenu hierarchy need not be similarly structured. Submenus may be configurable based on their parent item or a parent menu.

Additionally, though not shown in this example, the time increments in a single submenu need not be the same within that submenu. For example, a dryer control user interface 10 may be configured so that the first three "Timed Dry" operation times are 5 minutes, 10 minutes, and then 20 minutes.

Additionally, note that all of the state transition arrows in this example are one-directional. As mentioned above, this indicates that the user in this configuration will need to keep turning the control knob 20 in the same direction to cycle through all possible selections in the menu/submenu hierarchy before returning to the start of the hierarchy. Such configurations, with only one-directional state transition arrows, may provide certain operational advantages with respect to user interface design. For example, a state transition diagram such as the one shown in FIG. 4 is only responsive to the turning of the control knob 20 in one direction. Thus, the dryer user interface 10 may be designed so that other dryer settings are controlled by the turning of the same control knob 20 in the opposite direction. In an alternative arrangement, bi-directional navigation is provided in a manner similar to that as is shown in FIG. 3.

Further, the number in the display need not correspond to time and can correspond to another variable forming a submenu. For example, in the Delicate mode, multiple numbers could be used to designate the degree of delicates. Thus, you could have states "Delicate 1", "Delicate 2" and "Delicate 3" reflecting a degree of delicacy of the laundry to be dried. Thus, a setting of "Delicate 1" could be used as a setting for the routine delicate laundry, and a setting of "Delicate 3" could be used for the most delicate laundry. In such an arrangement, the numerical display 40 would display a "1", "2", or a "3", for example, to designate a non-time numerical variable setting.

Figure 2:
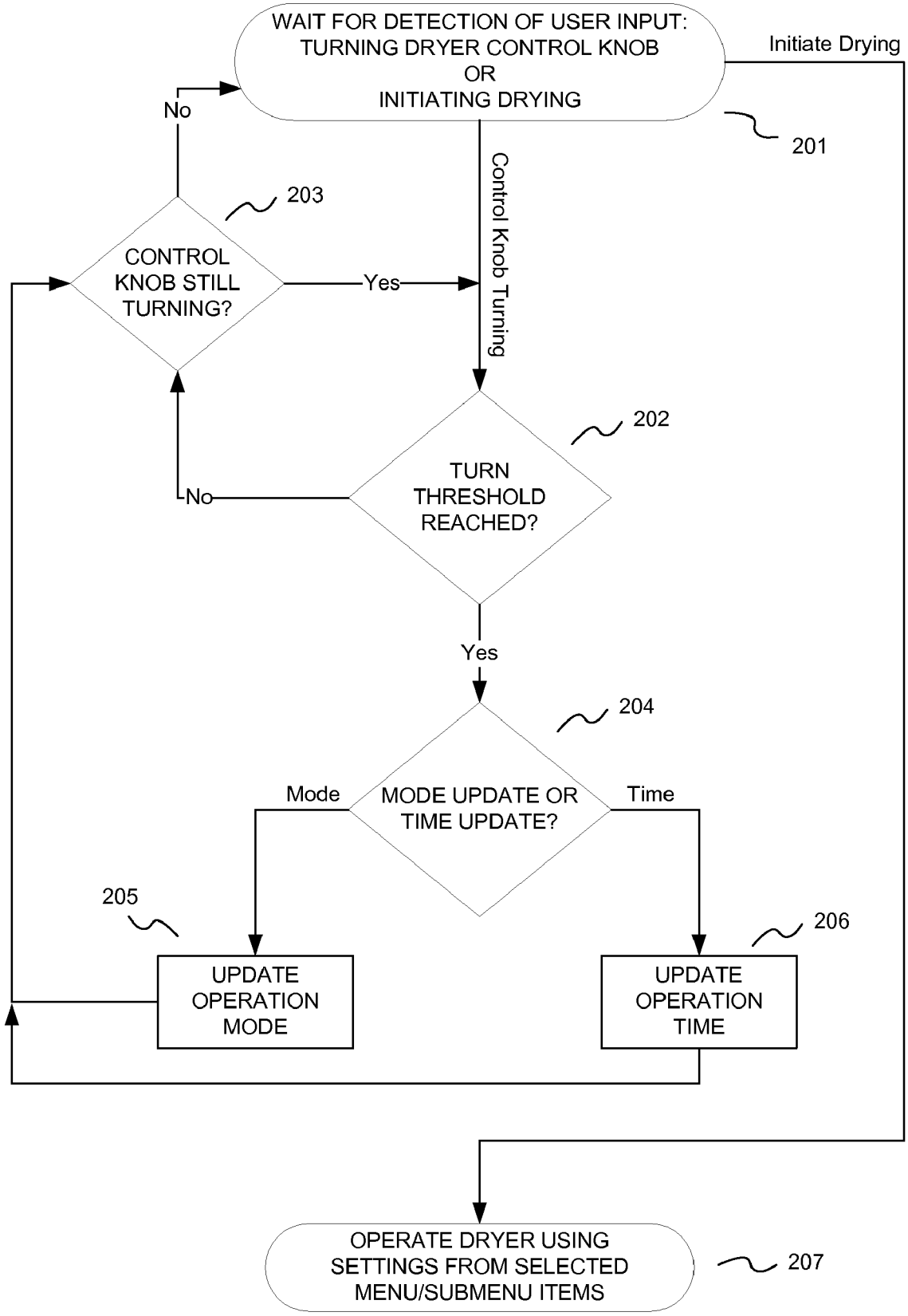
FIG. 2 is a flow diagram illustrating usage of a dryer control user interface in accordance with certain aspects of the invention.

In FIG. 2, a flow diagram is shown describing an illustrative method for determining one or more settings for the operation of a dryer 15 by turning a single control knob 20. In step 201, the dryer 15 remains dormant until receiving input from a user via the dryer control user interface 10. The dryer 15 stays in this state until the dryer controller detects either, that a user is turning the control knob 20, or that the user has initiated a drying cycle. It is understood that the sensor(s) used would also assist in determining the direction of rotation. If the user has initiated a drying cycle, such as by pressing the knob 20 inwardly, the controller will perform the steps necessary to start the dryer 15 and commence the drying of the load in step 207. When the user initiates a drying cycle, the controller may retrieve the most recent user-selected operation mode and operation time for use in the drying cycle. Thus, in the example shown in FIG. 2, if the user never turns the control knob 20, then the dryer 15 will simply use the previously-set mode and time for the drying.

However, in step 201 if the user turns the control knob 20, then the controller of the dryer 15 detects this action and determines in step 202 if the knob 20 has been turned enough to reach the turn threshold. A turn threshold is a predetermined rotational distance (e.g., a number of degrees of rotation) that the knob 20 must move before the dryer controller determines that the selected operation mode and/or operation time for the dryer 15 should be changed. Of course, some dryers 15 may be configured to have no turn threshold, meaning that the operation mode and operation time will be updated whenever any amount of turning of the knob 20 is detected by the controller.

In contrast, for dryers 15 with a turn threshold, a user might just slightly move the control knob 20 without reaching the turn threshold. In case a such, the controller determines in step 202 that the operation mode and time of the dry cycle are not to be changed based on the movement of the control knob 20. However, subsequent continuing movement of the knob 20 might still be determined to reach the turn threshold. Thus, in step 203, if the user is still turning the knob 20, then additional measurements are made to determine if the turning is substantial enough to reach the turn threshold.

When a more substantial turn of the control knob 20 has occurred, and the turn threshold is reached in step 202, the controller determines that the user is attempting to update the mode and/or time settings for the dryer 15. Accordingly, control continues on to sections 204-206 to determine and update the new user-selected operation mode and operation time.

The turn threshold may also be coordinated with other related components of the dryer control user interface 10 to improve usability. For example, a notched control knob 20 and/or corresponding notches on the control panel adjacent to the knob (i.e., a detented arrangement) may provide a desired amount of resistance and may correspond to discrete turn thresholds for user convenience. In more complex systems, haptic feedback and other force feedback technology may be integrated into the controller knob 20 to improve the overall user experience of the dryer control interface 10.

In step 204, the controller determines whether the operation mode or operation time dryer setting is to be updated (e.g., by traversing the menu-submenu hierarchy as described in greater detail with reference to FIGS. 3-4). For example, in reference to FIG. 1, if the current operation mode is "Normal," and no user time options are available for the "Normal" operation mode, then a new operation mode would be set (e.g., "Permanent Press") in step 205. However, if the current operation mode is "Timed Dry," for which the user specifies the duration of the dry cycle, then a new operation time might be set in step 206 (e.g., changing the dry cycle time from 10 minutes to 20 minutes), while the current operation mode of "Timed Dry" would remain unchanged.

The updating steps 205 and 206 may involve both updates of stored information in the controller of the dryer 15, and updates to the dryer control user interface 10. For example, during the operation mode update in step 205 described above, the controller may switch off the "Normal" LED 33 and switch on the "Perm. Press" LED 34. During an operation time update in 206, the controller may change the value displayed in the estimated time remaining screen 40.

After updating either the current operation mode in step 205 to the next operation mode, or updating the current operation time in step 206 to the next operation time, control proceeds to step 203 to determine if the knob 20 is still being turned by the user. If the control knob 20 is still being turned, the new turn distance is once again compared to the turn threshold in step 202, before performing another mode or time update in steps 205 or 206. Thus, as long as the user continues to the turn the control knob 20, the mode and time settings for the dryer 15 and the user interface 10 will be continually updated as the different possible variations are cycled through.

Referring back to FIG. 1, other user interface components may optionally be positioned on the control panel of the dryer 15. For example, the temperature component 50 may include a button 51 and output LEDs 53 for setting and monitoring the dryer temperature setting. The signal component 60 includes a button 61 and LEDs 63 indicating whether or not the audible dryer cycle termination signal will be sounded at the completion of load drying. In one arrangement, the primary control element 19, e.g., the knob 20, is the only user control element on the control panel and thus all user inputs are made by this element. This simplifies the interface and provides efficiencies in the operation.

Using these components, users may set the appropriate temperature, mode of operation, dry time, completion signal, and other settings for their drying loads. Many more drying features and user preferences are now supported by modern dryers, making the efficient use of the limited space in the dryer control user interface a relevant consideration. According to a conventional dryer user interface, several different dryer operation modes, for which the drying time is automatically determined, are positioned around a single dial in a dryer control user interface. Additionally, one or more "Timed Dry" operation modes, for which users specify the drying time duration, are positioned around the same dial. Certain shortcomings arise from this conventional interface. Namely, the multiple operation modes and times can become crowded around the single dial, resulting in user difficulties in locating and setting the desired mode and time settings. This system greatly simplifies usage. It reduces the possibility for a laundry mode to be selected in error as compared to other laundry appliances. This is especially helpful as laundry appliances are sometimes installed in basements and garages where lighting conditions may be less than ideal.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. A laundry appliance, comprising:

a control element;

a user interface having a first display region configured to display a primary operating mode of the laundry appliance and a second display region configured to display a secondary operating mode associated with at least one of the primary operating modes;

a processor controlling at least some operating of the laundry appliance; and memory storing computer executable instructions that, when executed by the processor, cause the laundry appliance to perform a method comprising:

detecting a first manipulation of the control element;

identifying a current primary operating mode;

determining whether the current primary operating mode has a plurality of associated secondary operating modes;

if there does not exist a plurality of secondary operating modes associated with the current primary operating mode, changing the primary operating mode of the laundry appliance to a new primary operating mode;

if there does exist a plurality of secondary operating modes associated with the current primary operating mode, identifying a current secondary operating mode, determining whether the current secondary operating mode is a last in a predetermined sequence of secondary operating modes, and if the current secondary operating mode is the last in the predetermined sequence of secondary operating modes changing the primary operating mode of the laundry appliance to a new primary operating mode, and if the current secondary operating mode is not the last in the predetermined sequence of secondary operating modes, retaining the same current primary operating mode and changing the secondary operating mode of the laundry appliance to a next secondary operating mode in the predetermined sequence of secondary operating modes.

2. The laundry appliance of claim 1, wherein the control element is a rotatable dial.

3. The laundry appliance of claim 2, wherein the rotatable dial is also axially displaceable to initiate operation of the laundry appliance based on the displayed primary operating mode.

4. The laundry appliance of claim 1, wherein the rotatable dial is the only user-manipulable control element on the user interface that is used to control the primary operating mode and the secondary operating mode.

5. The laundry appliance of claim 1, wherein the second display region corresponds to a digital time display region, and wherein the secondary operating mode associated with at least one primary operating mode corresponds to time.

6. The laundry appliance of claim 1, wherein the first display region and the second display region are separate regions on the user interface.

7. The laundry appliance of claim 6, wherein the first display region includes text indicia of the primary operating modes and respective illumination elements adjacent thereto.

8. The laundry appliance of claim 1, wherein the laundry appliance is a dryer for drying laundry.

9. The laundry appliance of claim 1, wherein the first display region and the second display region are positioned on the user interface separate from the control element.

10. The laundry appliance of claim 9, wherein the first display region comprises text indicia describing the primary operating modes and respective illumination elements, and wherein the second display region comprises a digital numeric or alphabetic display.

11. A method for controlling the operation of laundry appliance, comprising:

detecting a first manipulation of a control element on the laundry appliance;

identifying a current primary operating mode of the laundry appliance, wherein the laundry appliance has a plurality of primary operating modes, and wherein at least one of the primary operating modes has an associated plurality of secondary operating modes;

determining whether the current primary operating mode has a plurality of associated secondary operating modes;

if the current primary operating mode does not have a plurality of associated secondary operating modes, changing the primary operating mode of the laundry appliance to a next primary operating mode in a predetermined sequence of primary operating modes; and if the current primary operating mode does have a plurality of associated secondary operating modes:

identifying a current secondary operating mode;

determining whether the current secondary operating mode is a last in a predetermined sequence of secondary operating modes associated with the current primary operating mode;

if the current secondary operating mode is the last in the predetermined sequence of secondary operating modes changing the primary operating mode of the laundry appliance to a new primary operating mode; and if the current secondary operating mode is not the last in the predetermined sequence of secondary operating modes, retaining the same current primary operating mode and changing the secondary operating mode of the laundry appliance to a next secondary operating mode in the predetermined sequence of secondary operating modes.

12. The method of claim 11, wherein the laundry appliance is a dryer for drying laundry, and the secondary operating modes correspond to drying times for the primary operating modes.

13. The method of claim 12, further comprising displaying the first operating mode and the second operating mode on distinct display regions on a control panel of the dryer, wherein the distinct display regions are separate from the control element.

14. The method of claim 12, wherein the control element comprises a rotatable dial and wherein detecting the first manipulation of the control element comprises detecting rotation of the rotatable dial in a first direction.

15. The method of claim 11, further comprising displaying the primary operating mode in a first display region and displaying the secondary operating mode in a second display region, wherein the first display region and the second display region are positioned on a user interface of the laundry appliance separate from the control element.

16. The method of claim 15, wherein the first display region comprises text indicia describing the primary operating modes and respective illumination elements, and wherein the second display region comprises a digital numeric or alphabetic display.

17. A laundry appliance, comprising:

a rotatable control knob;

a user interface configured to display a primary operating mode and a secondary operating mode of the laundry appliance;

a processor controlling at least some operating of the laundry appliance; and memory storing computer executable instructions that, when executed by the processor, cause the laundry appliance to perform a method comprising:

detecting a user manipulation of the rotatable control knob;

identifying at least one of a current primary operating mode and a current secondary operating mode;

based on the user manipulation of the rotatable control knob, setting the current primary operating mode to a new primary operating mode and setting the current secondary operating mode to a new secondary operating mode for the laundry appliance;

updating a first display region of the user interface to display the new primary operating mode; and updating a second display region of the user interface to display the new secondary operating mode, wherein the first display region and the second display region are positioned separately from each other and separately from the rotatable control knob.

18. The laundry appliance of claim 17, wherein the first display region comprises text indicia describing the primary operating modes and respective illumination elements, and wherein the second display region comprises a digital numeric or alphabetic display.

* * * * *